US010913111B2

(12) United States Patent
Chen et al.

(10) Patent No.: US 10,913,111 B2
(45) Date of Patent: Feb. 9, 2021

(54) METHOD FOR VACUUM SMELTING AND VARIABLE PRESSURE SOLIDIFICATION FORMING ALUMINUM ALLOY PIECE WITH ULTRA-THIN WALL AND HIGH GAS TIGHTNESS

(71) Applicant: No.59 Institute of China Ordnance Industry, Chongqing (CN)

(72) Inventors: Qiang Chen, Chongqing (CN); Yuanyuan Wan, Chongqing (CN); Zhihui Xing, Chongqing (CN); Jianquan Tao, Chongqing (CN); Gaozhan Zhao, Chongqing (CN); Zhiwei Huang, Chongqing (CN); Ming Li, Chongqing (CN); Xiaosong Li, Chongqing (CN); Shuxin Chai, Chongqing (CN); Yanbin Wang, Chongqing (CN); Hong Zhan, Chongqing (CN); Maochuan Wang, Chongqing (CN)

(73) Assignee: No.59 Institute of China Ordnance Industry, Chongqing (CN)

( * ) Notice: Subject to any disclaimer, the term of this patent is extended or adjusted under 35 U.S.C. 154(b) by 0 days.

(21) Appl. No.: 16/704,790

(22) Filed: Dec. 5, 2019

(65) Prior Publication Data

US 2020/0324335 A1 Oct. 15, 2020

(30) Foreign Application Priority Data

Apr. 15, 2019 (CN) ..... 2019 1 0298554

(51) Int. Cl.
*B22D 27/15* (2006.01)
*B22D 18/06* (2006.01)

(52) U.S. Cl.
CPC ..... *B22D 27/15* (2013.01); *B22D 18/06* (2013.01)

(58) Field of Classification Search
CPC ..... B22D 27/15; B22D 18/06
See application file for complete search history.

(56) References Cited

U.S. PATENT DOCUMENTS 5,618,633 A * 4/1997 Swanson ..... B22C 9/04 428/593

FOREIGN PATENT DOCUMENTS

| | | |
|---|---|---|
| CN | 102728819 | 4/2014 |
| CN | 105087968 | 11/2015 |
| CN | 106583648 | 8/2018 |

* cited by examiner

*Primary Examiner* — Kevin P Kerns
*Assistant Examiner* — Steven S Ha
(74) *Attorney, Agent, or Firm* — Rankin, Hill & Clark LLP

(57) ABSTRACT

A method for vacuum smelting and variable pressure solidification forming aluminum alloy piece with ultra-thin wall and high gas tightness is provided, in which an induction heating furnace is set in a vacuum tank, a quartz crucible with thickness of 5~8 mm is used; a preheated aluminum alloy ingot is placed in the crucible, side doors of the tank is closed, and a vacuuming processing is performed for the tank; the melt is filled from the bottom layer of the casting; when the melt reaches to the top, the main valve and the air-release valve are turned on until the inside and outside pressures are consistent, and then the casting is taken out. The requirement of high air tightness for vacuum tank is reduced, and aluminum alloy casting with high quality can be obtained at lower cost.

3 Claims, 2 Drawing Sheets

METHOD FOR VACUUM SMELTING AND VARIABLE PRESSURE SOLIDIFICATION FORMING ALUMINUM ALLOY PIECE WITH ULTRA-THIN WALL AND HIGH GAS TIGHTNESS

CROSS REFERENCE TO RELATED APPLICATIONS

The present application claims priority to Chinese Patent Application No. 201910298554.7 filed on Apr. 15, 2019, the entire content of which are incorporated herein by reference.

FIELD OF THE INVENTION

The present invention relates to a technical field of aluminum alloy is manufacturing, particularly to a method for vacuum smelting and variable pressure solidification forming aluminum alloy piece with ultra-thin wall and high gas tightness.

BACKGROUND

With the increasing demand for weight reduction in aerospace industry, aluminum alloy castings are developing towards a tendency of thin wall and ultra-thin wall. For ultra-thin-walled aviation duct products with gas tightness requirements, because they present bending and variable section characteristics in three-dimensional direction, it is generally necessary to adopt an investment casting process and complete smelting and pouring procedure under vacuum so to ensure its low oxidation inclusion content and good mold-filling effect.

In the prior art, although there are technologies and methods for vacuum smelting and vacuum casting of aluminum alloy, it is difficult for the prior art to ensure product quality for ultra-thin-walled duct products requiring high cleanliness, low casting amount of one time and high mold-filling.

It is found by the document retrieval that the China patent application publication No. CN105087968A describes an optimized production method for producing aluminum alloy casting by a vacuum smelting and pouring process.

In the patent application, a shell of a casting mold and a smelting furnace are simultaneously placed in the same vacuum vessel to realize the process of smelting and casting formation under vacuum. This method simplifies the production flow and realizes that the process from smelting to pouring solidification of aluminum alloy melt could be completed in a full vacuum environment, and the oxidation inclusion in the melt can be effectively controlled. However, this patent application does not perform improvement and control on the smelting time. In a case where the ultra-thin-walled aluminum alloy duct is produced by this method, because the casting mold is small, the is temperature of the casting mold is decreased rapidly after the casting mold is transferred from the roasting furnace to the vacuum tank; If the smelting time is not well controlled, the temperature of the casting mold will be too low due to a long time smelting, thereby reducing the mold-filling effect. In addition, the solidification pressure in this patent application is normal pressure, so it is difficult to ensure the air tightness of the casting of which the interior bears pressure.

It is found by the document retrieval that the China patent application publication No. CN10728819B describes an integrated vacuum smelting apparatus and method for accurately and quantitatively pouring aluminum alloy and magnesium alloy. By setting the first and second crucibles, this method realizes the separation of smelting procedure and pouring procedure, the melt is not oxidized during the whole smelting, and the liquid level measurement and the control on transferred liquid amount can be realized. However, in this technique, the pressure in the liquid transfer process is 5~10 MPa. For the melt of aluminum alloy with a density of 2.5 g/cm$^3$, this pressure may result in that the melt is in a high-speed flow state, which is not suitable for the pouring formation of small thin-walled castings. In addition, the second crucible in this method only supports flowing into the cavity of the casting mold under the action of gravity, which cannot guarantee the completion of pouring of all the alloy melt during pouring process every time. Moreover, the sealing and liquid transfer mechanisms in the second crucible is complicated, which is not conducive to the cleaning of the crucible after pouring every time, thereby easily leading to the contamination of the alloy melt during the second time of pouring.

To sum up, the problems existing in the prior art are as follows:

(1) It is difficult for the prior art to ensure product quality for ultra-thin-walled duct products requiring high cleanliness, low casting amount of one time and high mold-filling.

(2) The temperature of the casting mold will be too low due to the long time smelting process, thereby reducing the mold-filling effect. In addition, the solidification pressure is normal pressure, so it is difficult to ensure the air tightness of the casting of which the interior bears pressure.

(3) The melt is in a high-speed flow state, which is not suitable for the pouring formation of small thin-walled castings. Moreover, it cannot guarantee the completion of pouring of all the alloy melt because of the gravity casting, and it is not conducive to the cleaning of the crucible due to the complicated mechanisms of the crucible, thereby easily leading to the contamination of the alloy melt during the second time of pouring.

Difficulty and significance of solving the above technical problems:

The method for vacuum smelting and variable pressure solidification forming aluminum alloy piece with ultra-thin wall and high gas tightness provided by the present invention is simple in operation and high in integration degree, and thus is easy to be widely used in industrial production, which has great significance to promote the promotion and application of aluminum alloy casting in the aerospace field.

SUMMARY OF THE INVENTION

In view of the above problems in the prior art, the present invention provides a method for vacuum smelting and variable pressure solidification forming aluminum alloy piece with ultra-thin wall and high gas tightness. This method has the advantages of high melting efficiency, less oxidation inclusion and compact working procedure, while the mold-filling effect of the thin-wall and the densification of microstructure are considered. Moreover, this method is simple in operation and high in integration degree, and thus is easy to be widely used in industrial production, which has great significance to promote the promotion and application of aluminum alloy casting in the aerospace field.

The first purpose of the present invention is to provide a method for vacuum smelting and variable pressure solidification forming aluminum alloy piece with ultra-thin wall and high gas tightness, in which aluminum alloy is heated by medium frequency induction, and the smelting environment is a low vacuum environment after being subjected to nitrogen washing; a high purity quartz crucible is used as smelting vessel and aluminum alloy material is added to realize the whole casting of one time addition; during a mold-filling of melt, the furthest ends at different heights of the casting is ensured to be well filled and the solidification pressure of the castings is increased.

Furthermore, the method for vacuum smelting and variable pressure solidification forming aluminum alloy piece comprises:

Step 1: setting a medium frequency induction heating furnace in a vacuum tank, wherein a quartz crucible of which a thickness is 5~8 mm is used as a crucible of the heating furnace and a quartz purity is no less than 99.99%.

Step 2: placing an aluminum alloy ingot preheated to 300~350° C. in the quartz crucible, closing side doors of the vacuum tank, and performing a vacuuming processing for the interior of the tank in a manner of vacuum replacement.

Step 3: after the mold-filling of the first layer structure of the casting is completed with the melt, conducting the first wire, wherein at this time, the first pressure valve is turned on and the pressure in the vacuum tank is adjusted to −0.03~0.02 MPa; after the mold-filling of the second layer structure of the casting is completed with the melt, conducting the second wire, wherein at this time, the second pressure valve is turned on and the pressure in the vacuum tank is adjusted to −0.01~−0.005 MPa; after the mold-filling of the third layer structure of the casting is completed with the melt, conducting the third wire, is wherein at this time, the third pressure valve is turned on and the pressure in the vacuum tank is adjusted to 0.1-0.2 MPa; after the mold-filling of the fourth layer structure of the casting is completed with the melt, conducting the fourth wire, wherein at this time, the fourth pressure valve is turned on and the pressure in the vacuum tank is adjusted to 0.3-0.36 MPa; and then, After the pressure is maintained for 260~340 s, turning on an air-release valve of the tank until the pressures inside and outside the tank are consistent, and taking out the casting by opening the tank.

Further, in the step 1, the casting mold which is preheated to 280~320° C. is placed below the heating furnace, four layers of stainless steel wires are respectively placed at the furthest end positions of the mold-filling by the melt at different heights along the gravity direction in the casting mold, and the ends of the wires are connected to a pressure adjusting system of the vacuum tank.

Further, in the step 2, a vacuuming processing is performed for the interior of the tank in a manner of vacuum replacement, and after the vacuum is stabilized, the interior of the tank is continued to vacuum to −0.08~−0.09 MPa; then, nitrogen with a purity of 99.99% is injected into the interior of the tank to make the pressure in the tank reach to 0.26~0.3 MPa; then the vacuum tank is vacuumed to make the vacuum degree of the interior of the tank reach to −0.05~−0.06 MPa, and the transfer procedure of atmospheric pressure—vacuum high pressure—vacuum inside the tank is completed within 150~180 s; when the vacuum tank is vacuumed for the first time, the medium frequency induction furnace is powered on to melt the aluminum alloy, and all of the aluminum alloy is melt within 350~380 s; and when the temperature of the melt reaches to 710~720° C., the temperature is maintained for 20~40 s, the power supply of the heating furnace is disconnected, and the induction furnace is tilted to start pouring of the casting.

Another purpose of the present invention is directed to provide an aluminum alloy member with an ultra-thin wall and high gas tightness obtained by the method for vacuum smelting and variable pressure solidification forming aluminum alloy piece with ultra-thin wall and high gas tightness, wherein an air tightness test is performed on the casting of the aluminum alloy member with ultra-thin wall and high air tightness under the pressure of 0.08~0.12 MPa. The pressure drop is not greater than 0.0025 MPa after the pressure is maintained for 60 minutes. The wall thickness of the main body of the casting is 1±0.2 mm, the difference in wall thickness is not greater than ±0.1 5mm, and the internal quality of the casting is level one.

Another purpose of the present invention is directed to provide an aluminum alloy casting manufactured by the method for vacuum smelting and variable pressure solidification forming aluminum alloy piece with ultra-thin wall and high gas tightness.

Another purpose of the present invention is directed to provide a vehicle containing the aluminum alloy casting.

Another purpose of the present invention is directed to provide an aircraft containing the aluminum alloy casting.

Another purpose of the present invention is directed to provide a spacecraft containing the aluminum alloy casting.

Another purpose of the present invention is directed to provide an engine containing the aluminum alloy casting.

To sum up, the advantages and positive effects of the present invention are as follows:

In the present invention, the aluminum alloy is heated by medium frequency induction, the smelting period is short, and the smelting environment is a low vacuum environment after being subjected to nitrogen washing, which not only avoids the cost of the smelting protection of the high purity argon, but also reduces the requirement of high air tightness for vacuum tank, and is aluminum alloy casting melt with high quality can be obtained at lower cost; a high purity quartz crucible is used as smelting vessel and aluminum alloy material is quantitatively added to realize the whole pouring of one time addition, so that the aluminum alloy material is used efficiently, the process is simple and the melt is pollution-free; during a mold-filling of the melt, on the premise that the furthest ends at different heights of the castings are ensured to be well filled, the solidification pressure of the castings is increased, so that the densification of the microstructure of the casting solidified at different periods is not affected by the gas separate out due to the melt solidification, and the internal quality of the casting at each solidification stage can be guaranteed; an air tightness test is performed on the casting under the pressure of 0.08~0.12 MPa, the pressure drop is not greater than 0.0025 MPa after the pressure is maintained for 60 minutes, the wall thickness of the main body of the casting is 1±0.2 mm, the difference in wall thickness is not greater than ±0.15 mm, and the internal quality of the casting is level one.

The present invention provides a method for vacuum smelting and variable pressure solidification forming aluminum alloy piece with ultra-thin wall and high gas tightness, which has high melting efficiency, less oxidation inclusion and compact working procedure, while the mold-filling effect of the thin-wall and the densification of microstructure are also considered. Moreover, this method is simple in operation and high in integration degree, and thus is easy to be widely used in industrial production, which has great significance to promote the promotion and application of aluminum alloy casting in the aerospace field.

REFERENCE SIGNS IN THE DRAWINGS

1 vacuum tank body; 2 medium frequency induction furnace; 3 quartz crucible; 4 vacuum valve; 5 first pressure valve; 6 second pressure valve; 7 third pressure valve; 8 fourth pressure valve; 9 side doors of vacuum tank; 10 pressure adjusting system of vacuum tank; 11 first wire; 12 second wire; 13 third wire; 14 fourth wire; 15 air-release valve; 16 casting mold

DESCRIPTION OF THE EMBODIMENTS

In order to make the purpose, technical solution and advantages of the present invention clearer, the present invention is further described in detail below in combination with the following embodiments. It should be understood that the following embodiments are only used to explain the present invention but not intended to limit the invention.

Hereinafter, the configuration of the present invention will be described in detail in combination with the drawings.

Figure 2:
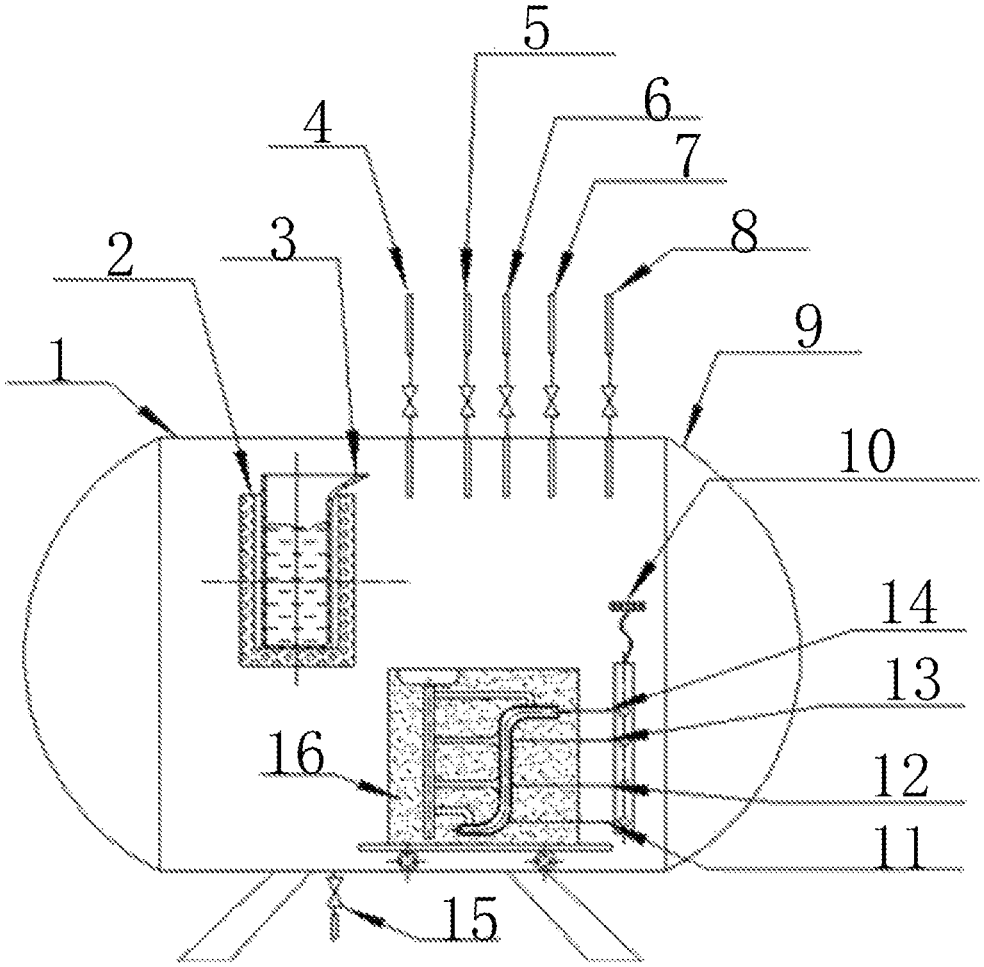
FIG. 2 is a schematic diagram of a structure of a vacuum tank provided in the embodiment of the present invention.

As shown in FIG. 2, the vacuum tank provided in the embodiments of the present invention includes a vacuum tank body 1, a medium frequency induction furnace 2, a quartz crucible 3, a vacuum valve 4, a first pressure valve 5, a second pressure valve 6, a third pressure valve 7, a fourth pressure valve 8, side doors 9 of the vacuum tank, a pressure adjusting system 10 of the vacuum tank, a first wire 11, a second wire 12, a third wire 13, a fourth wire 14, an air-release valve 15 and a casting mold 16.

The medium frequency induction furnace 2 is fixed inside the vacuum tank body 1 by bolts; the quartz crucible 3 is embedded in the upper portion of the medium frequency induction furnace 2; the upper portion of the vacuum tank body 1 is connected with the vacuum valve 4, the first pressure valve 5, the second pressure valve 6, the third pressure valve 7 and the fourth pressure valve 8; the side door 9 of the vacuum tank is arranged at the right side of vacuum tank body 1; the pressure adjusting system 10 of the vacuum tank is fixed inside the vacuum tank body 1 by bolts; the pressure adjusting system 10 of the vacuum tank is connected to the casting mold 16 by the first wire 11, the second wire 12, the third wire 13 and the fourth wire 14; the lower portion of the vacuum tank body 1 is connected with the air-release valve 15; and the casting mold 16 is fixed inside of the vacuum tank body 1 by bolts.

The application principles of the present invention are described in detail in combination with the drawings.

Figure 1:
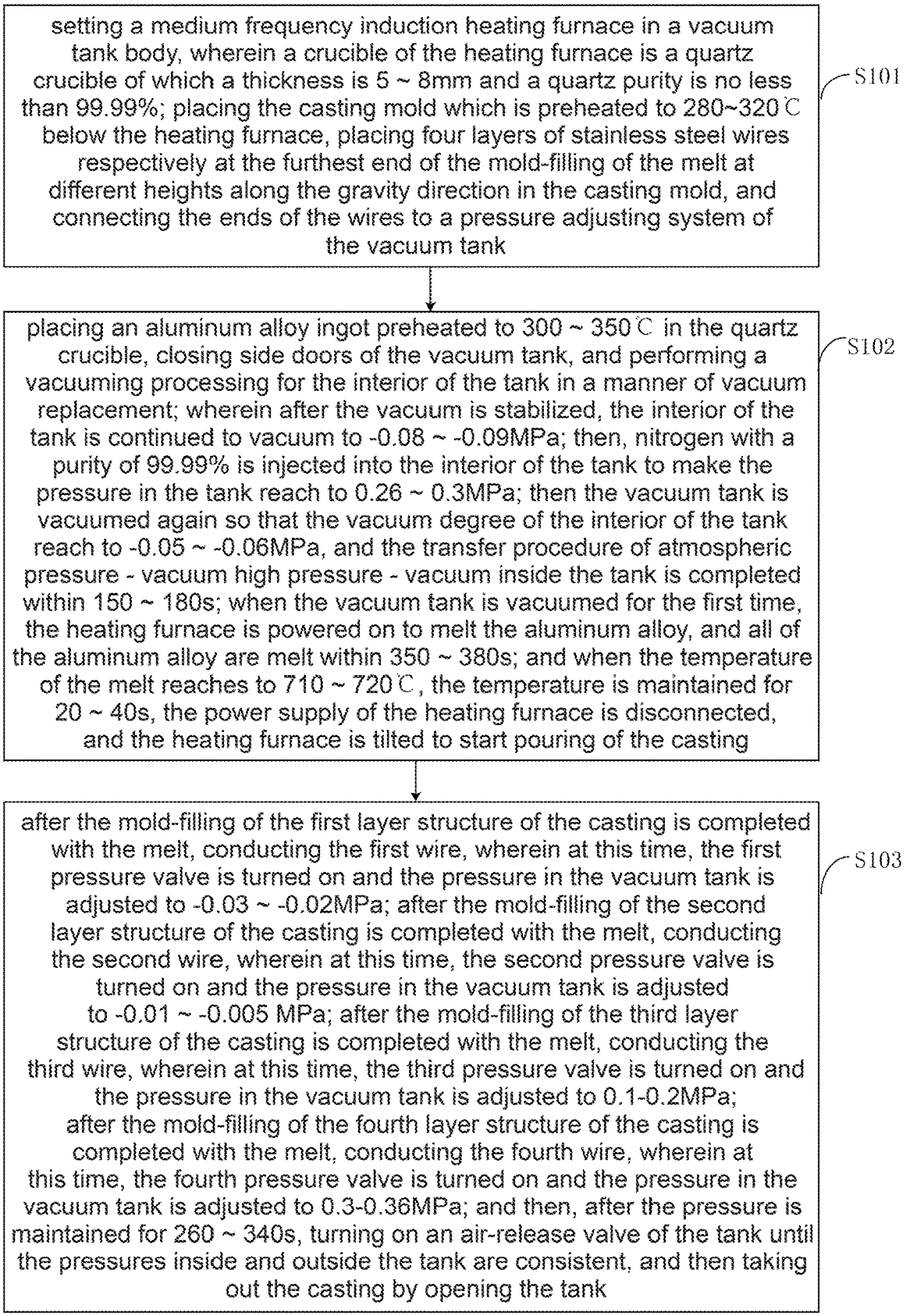
FIG. 1 is a flow chart of a method for vacuum smelting and variable pressure solidification forming aluminum alloy piece with ultra-thin wall and high gas tightness provided in the embodiment of the present invention.

As shown in FIGS. 1-2, the method for vacuum smelting and variable pressure solidification forming aluminum alloy piece with ultra-thin wall and high gas tightness provided in the embodiment of the present invention comprises the following steps:

S101: setting a medium frequency induction heating furnace in a vacuum tank body, wherein a crucible of the heating furnace is a quartz crucible of which a thickness is 5~8 mm and a quartz purity is no less than 99.99%;

wherein the casting mold which is preheated to 280~320° C. is placed below the heating furnace, four layers of stainless steel wires are respectively placed at the furthest end of the mold-filling of the melt at different heights along the gravity direction in the casting mold, and the ends of the wires are connected to a pressure adjusting system of the vacuum tank;

S102: placing an aluminum alloy ingot preheated to 300~350° C. in the quartz crucible, closing side doors of the vacuum tank, and performing a vacuuming processing for the interior of the tank in a manner of vacuum replacement; wherein after the vacuum is stabilized, the interior of the tank is continued to vacuum to −0.08~−0.09 MPa; then, nitrogen with a purity of 99.99% is injected into the interior of the tank to make the pressure in the tank reach to 0.26~0.3 MPa; then the vacuum tank is vacuumed again so that the vacuum degree of the interior of the tank reach to −0.05~−0.06 MPa, and the transfer procedure of atmospheric pressure—vacuum high pressure—vacuum inside the tank is completed within 150~180 s; when the vacuum tank is vacuumed for the first time, the medium frequency induction furnace is powered on to melt the aluminum alloy, and all of the aluminum alloy are melt within 350~380 s; and when the temperature of the melt reaches to 710~720° C., the temperature is maintained for 20~40 s, the power supply of the heating furnace is disconnected, and the heating furnace is tilted to start pouring of the casting.

S103: after the mold-filling of the first layer structure of the casting is completed with the melt, conducting the first wire, wherein at this time, the first pressure valve is turned on and the pressure in the vacuum tank is adjusted to −0.03~−0.02 MPa; after the mold-filling of the second layer structure of the casting is completed with the melt, conducting the second wire, wherein at this time, the second pressure valve is turned on and the pressure in the vacuum tank is adjusted to −0.01~−0.005 MPa; after the mold-filling of the third layer structure of the casting is completed with the melt, conducting the third wire, wherein at this time, the third pressure valve is turned on and the pressure in the vacuum tank is adjusted to 0.1-0.2 MPa; after the mold-filling of the fourth layer structure of the casting is completed with the melt, conducting the fourth wire, wherein at this time, the fourth pressure valve is turned on and the pressure in the vacuum tank is adjusted to 0.3-0.36 MPa; and then, after the pressure is maintained for 260~340 s, turning on an air-release valve of the tank until the pressures inside and outside the tank are consistent, and then taking out the casting by opening the tank.

In the present invention, the aluminum alloy is heated by medium is frequency induction, the smelting period is short, and the smelting environment is in a low vacuum environment after being subjected to nitrogen washing, which not only avoids the cost of the smelting protection with the high purity argon, but also reduces the requirement of high air tightness for vacuum tank, and aluminum alloy melt with high quality can be obtained at lower cost; a high purity quartz crucible is used as smelting vessel and aluminum alloy material is quantitatively added to realize the whole pouring of one time addition, so that the aluminum alloy material is used efficiently, the process is simple and the melt is pollution-free; during a mold-filling of the melt, on the premise that the furthest ends at different heights of the casting are ensured to be well filled, the solidification pressure of the casting is increased, so that the densification of the microstructure of the casting solidified at different periods is not affected by the gas separate out due to the melt solidification, and the internal quality of the casting at each solidification stage is guaranteed; an air tightness test is performed on the casting under the pressure of 0.08~0.12 MPa, the pressure drop is not greater than 0.0025 MPa after the pressure is maintained for 60 minutes, the wall thickness of the main body of the casting is 1±0.2 mm, the difference in wall thickness is not greater than ±0.15 mm, and the internal quality of the casting is level one.

Hereinafter, the application principles of the present invention are further described in combination with the specific embodiments.

First Embodiment: Duct Casting of ZL101A Aluminum Alloy

1. A medium frequency induction heating furnace is set in a vacuum tank body, and a quartz crucible of which the thickness is 5 mm is used as a crucible of the heating furnace and a quartz purity is no less than 99.99%; the casting mold which is preheated to 305° C. is placed below the heating furnace, four layers of stainless steel wires are respectively placed at the furthest end positions of the mold-filling of the melt at different heights along the gravity is direction in the casting mold, and the ends of the wires are connected to a pressure adjusting system of the vacuum tank.

2. An aluminum alloy ingot preheated to 300° C. is placed in the quartz crucible, side doors of the vacuum tank is closed, and a vacuuming processing is performed for the interior of the tank in a manner of vacuum replacement; after the vacuum is stabilized, the interior of the tank is continued to vacuum to −0.09 MPa; then, nitrogen with a purity of 99.99% is injected into the interior of the tank to make the pressure in the tank reach to 0.3 MPa; then the vacuum tank is vacuumed again so that the vacuum degree of the interior of the tank reaches to −0.06 MPa, and the transfer procedure of atmospheric pressure—vacuum high pressure—vacuum inside the tank is completed within 150 s; when the vacuum tank is vacuumed for the first time, the medium frequency induction furnace is powered on to melt the aluminum alloy, and all of the aluminum alloy is melt within 350 s; and when the temperature of the melt reaches to 710° C., the temperature is maintained for 40 s, then the power supply of the heating furnace is disconnected, and the induction furnace is tilted to start pouring.

3. After the mold-filling of the first layer structure of the casting is completed with the melt, the first wire is conducted, and at this time, the first pressure valve is turned on and the pressure in the vacuum tank is adjusted to−0.02 MPa; after the mold-filling of the second layer structure of the casting is completed with the melt, the second wire is conducted, and at this time, the second pressure valve is turned on and the pressure in the vacuum tank is adjusted to −0.01 MPa; after the mold-filling of the third layer structure of the casting is completed with the melt, the third wire is conducted, and at this time, the third pressure valve is turned on and the pressure in the vacuum tank is adjusted to 0.1 MPa; after the mold-filling of the fourth layer structure of the casting is completed with the melt, the fourth wire is conducted, and at this time, is the fourth pressure valve is turned on and the pressure in the vacuum tank is adjusted to 0.3 MPa; and then, after the pressure is maintained for 260 s, an air-release valve of the tank is turned on until the pressures inside and outside the tank are consistent, and then the casting is taken out by opening the tank.

An air tightness test is performed on the ZL101A casting under the pressure of 0.08 MPa, the pressure drop is 0.0021 MPa after the pressure is maintained for 60 minutes, the wall thickness of the main body of the casting is 1.2 mm, the difference in wall thickness is ±0.07 mm, and the internal quality of the casting is level one.

Second Embodiment: Duct Casting of ZL114A Aluminum Alloy

1. A medium frequency induction heating furnace is set in a vacuum tank body, and a quartz crucible of which a thickness is 7 mm is used as a crucible of the heating furnace and a quartz purity is no less than 99.99%; the casting mold which is preheated to 280° C. is placed below the heating furnace, four layers of stainless steel wires are respectively placed at the furthest end positions of the mold-filling of the melt at different heights along the gravity direction in the casting mold, and the ends of the wires are connected to a pressure adjusting system of the vacuum tank.

2. An aluminum alloy ingot preheated to 332° C. is placed in the quartz crucible, side doors of the vacuum tank is closed, and a vacuuming processing is performed for the interior of the tank in a manner of vacuum replacement; after the vacuum is stabilized, the interior of the tank is continued to vacuum to −0.08 MPa; then, nitrogen with a purity of 99.99% is injected into the interior of the tank to make the pressure in the tank reach to 0.26 MPa; then the vacuum tank is vacuumed again so that the vacuum degree of the interior of the tank reaches to −0.054 MPa, and the transfer procedure of atmospheric pressure—vacuum high pressure—vacuum inside the tank is completed within 166 s; when the vacuum tank is vacuumed for the first time, the medium frequency is induction furnace is powered on to melt the aluminum alloy, and all of the aluminum alloy is melt within 370 s; and when the temperature of the melt reaches to 714° C., the temperature is maintained for 29 s, the power supply of the heating furnace is disconnected, and the induction furnace is tilted to start pouring of the casting.

3. After the mold-filling of the first layer structure of the casting is completed with the melt, the first wire is conducted, and at this time, the first pressure valve is turned on and the pressure in the vacuum tank is adjusted to −0.025 MPa; after the mold-filling of the second layer structure of the casting is completed with the melt, the second wire is conducted, and at this time, the second pressure valve is turned on and the pressure in the vacuum tank is adjusted to −0.005 MPa; after the mold-filling of the third layer structure of the casting is completed with the melt, the third wire is conducted, and at this time, the third pressure valve is turned on and the pressure in the vacuum tank is adjusted to 0.2 MPa; after the mold-filling of the fourth layer structure of the casting is completed with the melt, the fourth wire is conducted, and at this time, the fourth pressure valve is turned on and the pressure in the vacuum tank is adjusted to 0.32 MPa; and then, after the pressure is maintained for 300 s, an air-release valve of the tank is turned on until the pressures inside and outside the tank are consistent, and then the casting is taken out by opening the tank.

An air tightness test is performed on the ZL114A casting under the pressure of 0.12 MPa, the pressure drop is 0.002 MPa after the pressure is maintained for 60 minutes, the wall thickness of the main body of the casting is 0.8 mm, the difference in wall thickness is ±0.11 mm, and the internal quality of the casting is level one.

Third Embodiment: Duct Casting of ZL205A Aluminum Alloy

1. A medium frequency induction heating furnace is set in a vacuum tank body, and a quartz crucible of which a thickness is 8mm is used as a crucible is of the heating furnace and a quartz purity is no less than 99.992%; the casting mold which is preheated to 320° C. is placed below the heating furnace, four layers of stainless steel wires are respectively placed at the furthest end positions of the mold-filling with the melt at different heights along the gravity direction in the casting mold, and the ends of the wires are connected to a pressure adjusting system of the vacuum tank.

2. An aluminum alloy ingot preheated to 350° C. is placed in the quartz crucible, side doors of the vacuum tank is closed, and a vacuuming processing is performed for the interior of the tank in a manner of vacuum replacement; after the vacuum is stabilized, the interior of the tank is continued to vacuum to −0.086 MPa; then, nitrogen with a purity of 99.99% is injected into the interior of the tank to make the pressure in the tank reach to 0.28 MPa; then the vacuum tank is vacuumed again so that the vacuum degree of the interior of the tank reaches to −0.05 MPa, and the transfer procedure of atmospheric pressure—vacuum high pressure—vacuum inside the tank is completed within 180 s; when the vacuum tank is vacuumed for the first time, the medium frequency induction heating furnace is powered on to melt the aluminum alloy, and all of the aluminum alloy is melt within 380 s; and when the temperature of the melt reaches to 720° C., the temperature is maintained for 20 s, the power supply of the induction heating furnace is disconnected, and the induction heating furnace is tilted to start pouring of the casting.

3. After the mold-filling of the first layer structure of the casting is completed with the melt, the first wire is conducted, and at this time, the first pressure valve is turned on and the pressure in the vacuum tank is adjusted to −0.003 MPa; after the mold-filling of the second layer structure of the casting is completed with the melt, the second wire is conducted, and at this time, the second pressure valve is turned on and the pressure in the vacuum tank is adjusted to −0.008 MPa; after the mold-filling of the third layer structure of the is casting is completed with the melt, the third wire is conducted, and at this time, the third pressure valve is turned on and the pressure in the vacuum tank is adjusted to 0.17 MPa; after the mold-filling of the fourth layer structure of the casting is completed with the melt, the fourth wire is conducted, and at this time, the fourth pressure valve is turned on and the pressure in the vacuum tank is adjusted to 0.36 MPa; and then, after the pressure is maintained for 340 s, an air-release valve of the tank is turned on until the pressures inside and outside the tank are consistent, and then the casting is taken out by opening the tank.

An air tightness test is performed on the ZL205A casting under the pressure of 0.1 MPa, the pressure drop is 0.0025 MPa after the pressure is maintained for 60 minutes, the wall thickness of the main body of the casting is 1 mm, the difference in wall thickness is ±0.15 mm, and the internal quality of the casting is level one.

The foregoing are only preferred embodiments of the present invention and are not intended to limit the present invention, and any modifications, equivalent replacements and improvements made in the spirit and principles of the present invention shall be covered by the protection of the present invention.

What is claimed is:

1. A method for forming an aluminum alloy piece, comprising the following steps:

Step 1: setting a frequency induction heating furnace in a vacuum tank, wherein a quartz crucible of which a thickness is 5~8 mm is used as a crucible of the heating furnace and a quartz purity is no less than 99.99%;

Step 2: placing an aluminum alloy ingot preheated to 300~350° C. in the quartz crucible, closing side doors of the vacuum tank, and performing a vacuuming processing for an interior of the vacuum tank in a manner of vacuum replacement;

Step 3: after mold-filling of a first layer structure of the aluminum alloy piece is completed with a melted aluminum alloy ingot, turning on a first pressure valve of a pressure adjusting system of the vacuum tank to adjust a pressure in the vacuum tank to be −0.03~0.02 MPa; after the mold-filling of a second layer structure of the aluminum alloy piece is completed with the melted aluminum alloy ingot, turning on a second pressure valve of the pressure adjusting system of the vacuum tank to adjust the pressure in the vacuum tank to be −0.01~0.005 MPa; after the mold-filling of a third layer structure of the aluminum alloy piece is completed with the melted aluminum alloy ingot, turning on a third pressure valve of the pressure adjusting system of the vacuum tank to adjust the pressure in the vacuum tank to be 0.1-0.2 MPa; after the mold-filling of a fourth layer structure of the aluminum alloy piece is completed with the melted aluminum alloy ingot, turning on a fourth pressure valve of the pressure adjusting system of the vacuum tank to adjust the pressure in the vacuum tank to be 0.3-0.36 MPa; and then, after the pressure is maintained for 260~340 s, turning on an air-release valve of the vacuum tank until the pressures inside and outside the vacuum tank are consistent, and taking out the aluminum alloy piece by opening the vacuum tank.

2. The method according to claim 1, wherein, in the step 1, the aluminum alloy ingot which is preheated to 280~320° C. is placed below the heating furnace, four layers of stainless steel wires are respectively placed at furthest end positions of the mold-fillings of the first, second, third, and fourth layer structures of the aluminum alloy piece at different heights along a gravity direction, and ends of the wires are connected to the pressure adjusting system of the vacuum tank.

3. The method according to claim 1, wherein, in the step 2, a vacuuming processing is performed for the interior of the tank in a manner of vacuum replacement, and after the vacuum is stabilized, the interior of the tank is continued to vacuum to −0.08~0.09 MPa; then, nitrogen with a purity of 99.99% is injected into the interior of the tank to make the pressure in the tank reach to 0.26~0.3 MPa; then the vacuum tank is vacuumed again to make a vacuum degree of the interior of the tank reach to −0.05~0.06 MPa, and a transfer procedure of atmospheric pressure - vacuum high pressure - vacuum inside the tank is completed within 150~180 s; when the vacuum tank is vacuumed for a first time, the frequency induction heating furnace is powered on to melt the aluminum alloy ingot, and all of the aluminum alloy ingot is melted within 350~380 s; and when a temperature of the melted aluminum alloy ingot reaches to 710~720° C., the temperature is maintained for 20~40 s, a power supply of the heating furnace is disconnected, and the heating furnace is tilted to start pouring of the aluminum alloy piece.

* * * * *